US006200215B1

(12) United States Patent
Larsson et al.

(10) Patent No.: US 6,200,215 B1
(45) Date of Patent: Mar. 13, 2001

(54) FAN MODULE FOR CLEAN ROOM APPLICATIONS

(75) Inventors: Bertil Larsson, Tyresä; Peter Jansson, Enköping, both of (SE)

(73) Assignee: ABB Fläkt AB, Stockholm (SE)

( * ) Notice: Subject to any disclaimer, the term of this patent is extended or adjusted under 35 U.S.C. 154(b) by 0 days.

(21) Appl. No.: 09/446,386

(22) PCT Filed: Jun. 24, 1998

(86) PCT No.: PCT/SE98/01230

§ 371 Date: Dec. 21, 1999

§ 102(e) Date: Dec. 21, 1999

(87) PCT Pub. No.: WO99/02926

PCT Pub. Date: Jan. 21, 1999

(30) Foreign Application Priority Data

Jun. 27, 1997 (SE) ..... 9702485

(51) Int. Cl.[7] ..... F24F 7/06

(52) U.S. Cl. ..... 454/187; 55/471; 55/473; 181/225

(58) Field of Search ..... 454/187; 55/467, 55/471, 473; 181/225

(56) References Cited

U.S. PATENT DOCUMENTS

| | | | | |
|---|---|---|---|---|
| 4,371,386 | | 2/1983 | DeVecchi . | |
| 4,549,472 | * | 10/1985 | Endo et al. | 454/187 |
| 4,560,395 | | 12/1985 | Davis . | |
| 4,616,732 | * | 10/1986 | Carboni | 181/225 X |
| 5,053,065 | * | 10/1991 | Garay et al. | 55/473 X |
| 5,297,990 | * | 3/1994 | Renz et al. | 454/187 |
| 5,364,425 | * | 11/1994 | Simon et al. | 55/471 X |
| 5,462,484 | | 10/1995 | Jung et al. | 454/187 |
| 5,496,389 | * | 3/1996 | Wilcox | 55/473 |
| 5,733,348 | * | 3/1998 | Skarsten | 55/473 X |
| 5,961,702 | * | 10/1999 | Doneit | 55/473 X |
| 6,019,808 | * | 2/2000 | Ishikawa et al. | 55/471 X |
| 6,033,301 | * | 3/2000 | Suwa | 454/187 |

FOREIGN PATENT DOCUMENTS

| | | |
|---|---|---|
| 3422900A1 | 1/1986 | (DE) . |
| 4115171A1 | 11/1992 | (DE) . |
| 4412583C1 | 9/1995 | (DE) . |
| 29600210 U | 4/1996 | (DE) . |
| 0348011 | 12/1989 | (EP) . |
| 0497296A2 | 8/1992 | (EP) . |
| 0722072A2 | 7/1996 | (EP) . |

* cited by examiner

*Primary Examiner*—Harold Joyce
(74) *Attorney, Agent, or Firm*—Burns, Doane, Swecker & Mathis LLP

(57) ABSTRACT

A fan module for clean room applications, comprising outer, vertical restriction walls (5) with a lower edge part (6) having a planar lower surface (7) as well as an element (9) protruding from the outer edge of the planar lower surface for cooperation with a filter docking module (2) provided in a roof filter frame (4) having a substantially planar upper surface (8) with an extension corresponding to said planar lower surface, whereby said protruding element (9) is designed to overlap part of said filter docking module (2).

11 Claims, 4 Drawing Sheets

FAN MODULE FOR CLEAN ROOM APPLICATIONS

TECHNICAL FIELD

The present invention relates to a fan module for use in clean room applications.

TECHNICAL BACKGROUND

A filter-fan-unit designed as a modular unit in clean room applications is previously known, see for instance Babcock-BSH "Clean room-tunnel-module", prospect paper II/87. Adjacent to a side wall of this unit there is a fan with which the air is sucked in and transported into an air flow room, extended from the horizontal outlet of the fan to the opposite wall, then reversed 180° and limited downwards by the filter means placed under the partition wall and at a distance therefrom. With this design the air will have long flow distances leading to correspondingly high flow losses and a correspondingly high energy consumption. This air guidance also makes it very difficult to obtain an even flow distribution over the filter surface. Further, this device has a comparatively high sound pressure level.

Efforts have been made to overcome the drawbacks of this known structure, e.g. according to EP,C,497296, wherein the flow room has been designed as one or several annular channels, and wherein at least one of the walls of the flow room is made of a sound-absorbing material. This is not an optimal solution either in view of flow stabilization and silencing of noise.

SUMMARY OF THE INVENTION

One object of the invention is to provide a fan module with enhanced flexibility compared to prior art fan modules.

Another object of the invention is to provide a fan module with better noise silencing characteristics compared to prior art fan modules.

The above and other objects of the present invention are achieved with the fan module according to the present invention, which is characterized in that it comprises outer, vertical restriction walls with a lower edge part having a planar lower surface as well as an element protruding from the outside edge of the planar lower surface for cooperation with a filter docking module arranged in a roof filter frame and having a substantial planar upper surface with an extension corresponding to said planar lower surface, whereby said protruding element is designed to overlap part of said filter docking module.

Developments and embodiments of the invention are disclosed in the subclaims and in the following detailed description of the invention.

SHORT DESCRIPTION OF THE DRAWINGS

Figure 1:
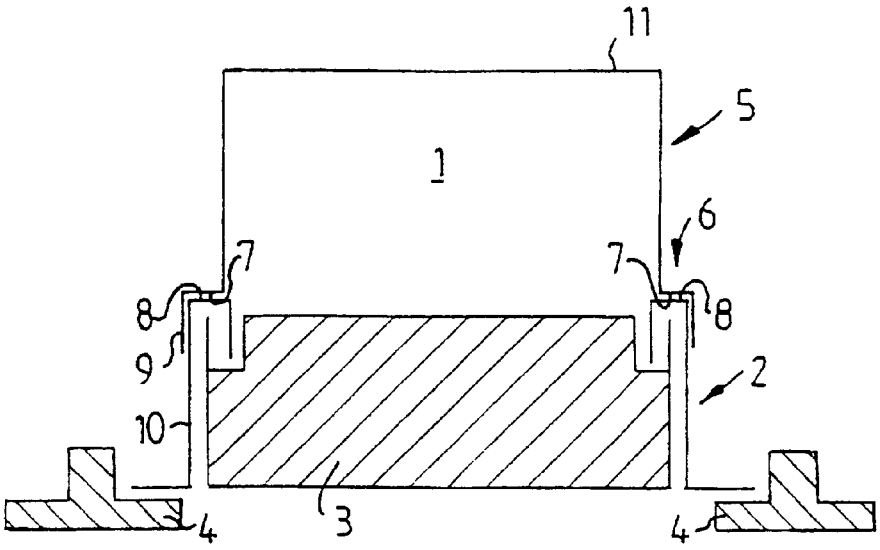
Figure 2:
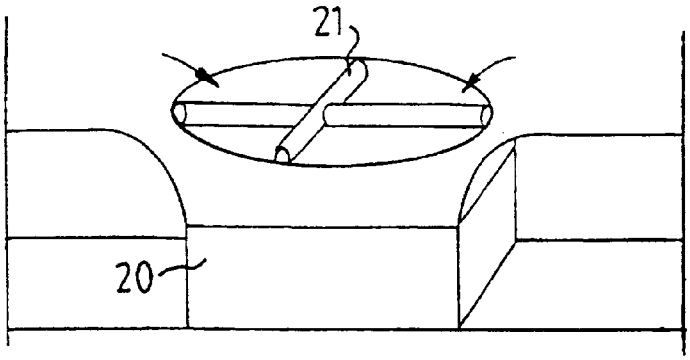
Figure 3:
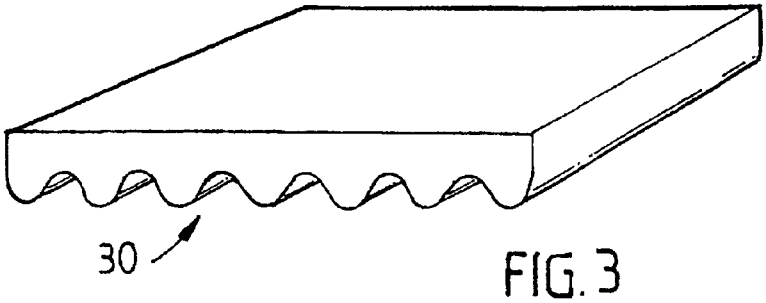
Figure 4:
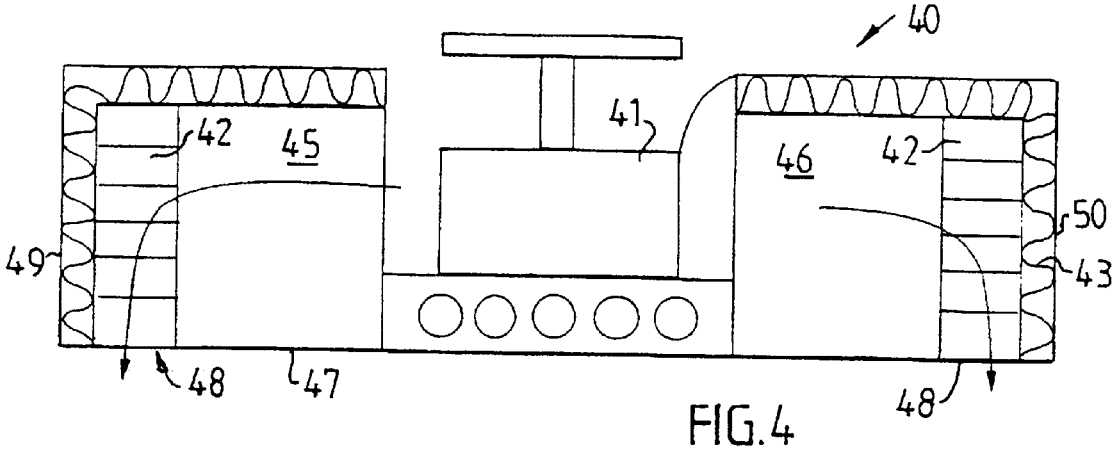
Figure 5:
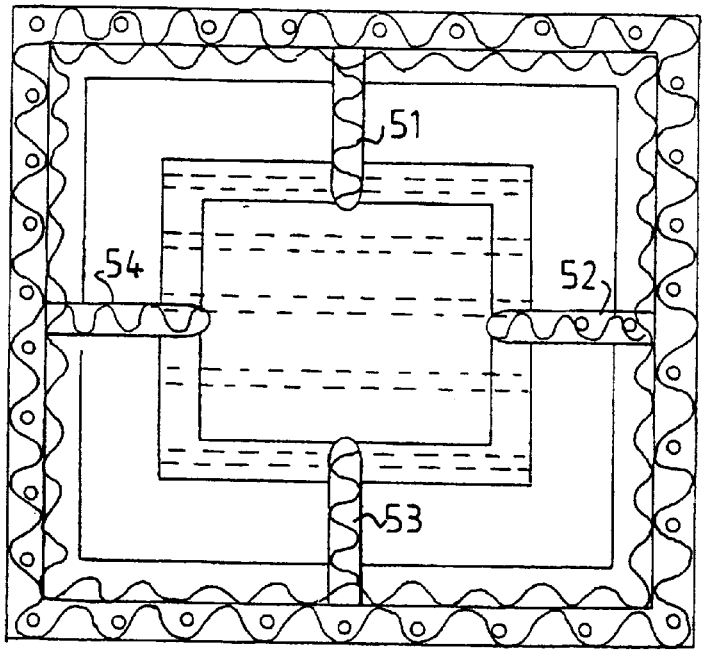
Figure 6:
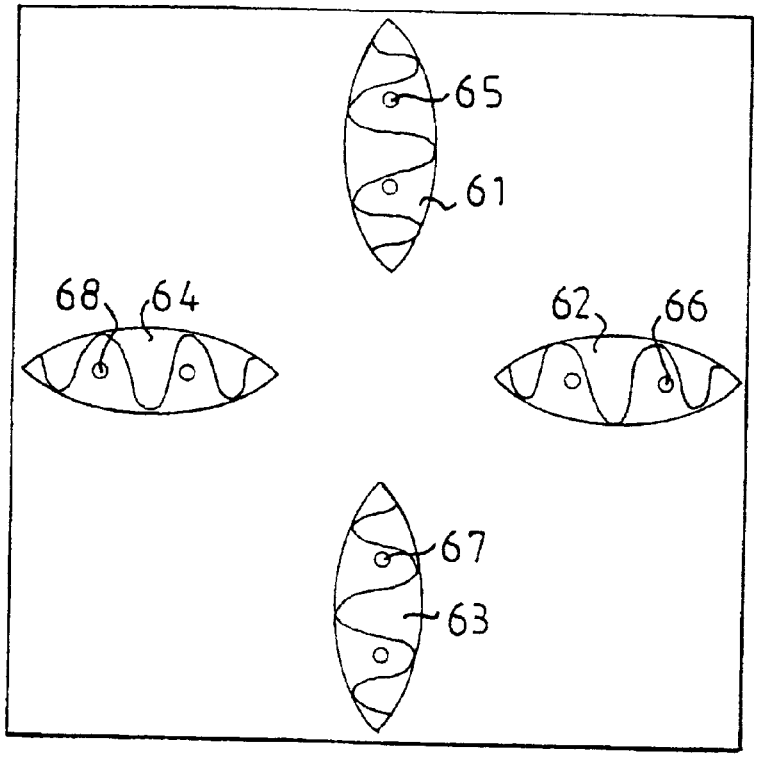
Figure 7:
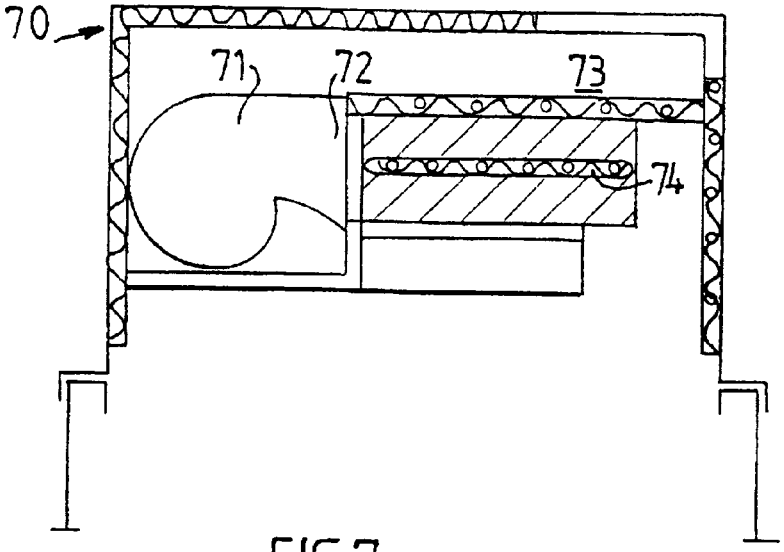
Figure 8:
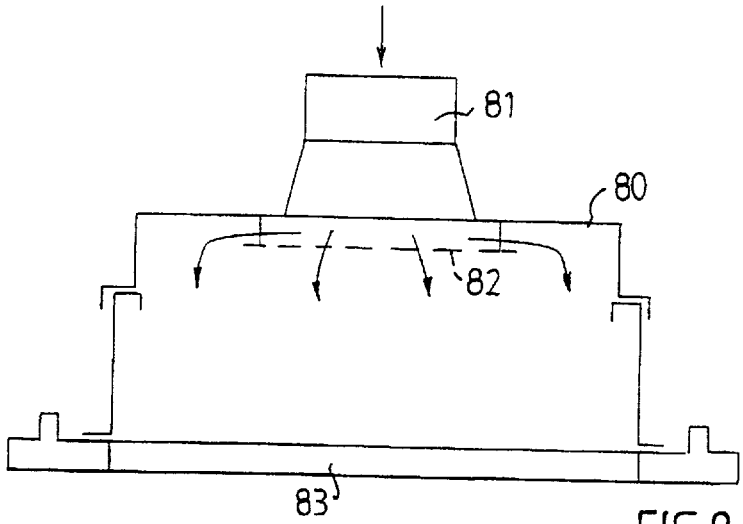
Figure 9:
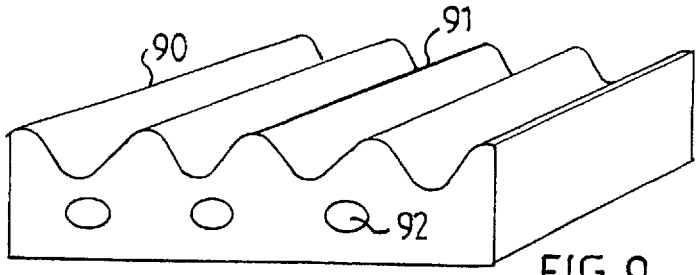
Figure 10:
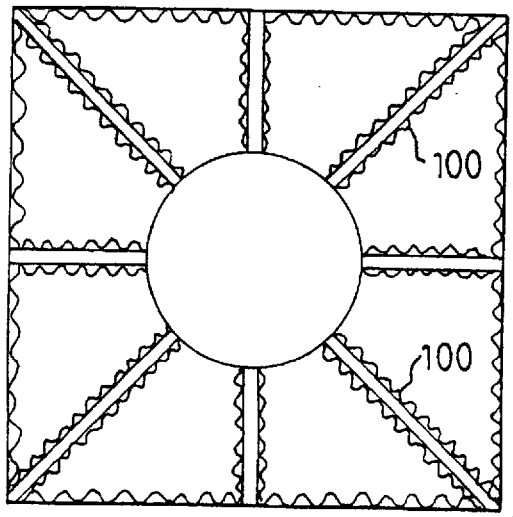

Further objects, features and advantages of the invention will be evident from the following description of preferred embodiments of the invention with reference to the appended, schematic drawings, showing in FIG. 1 a principal view of a fan module according to the invention with a roof filter frame and a filter shown in cross-section;

FIG. 2 an inlet-cross according to the invention;

FIG. 3 part of an insulation for application on or forming an air flow channel element or guide element:

FIG. 4 a cross-sectional side view of a fan module according to the invention;

FIG. 5 a cross-sectional view taken from above of the air discharge channel opening above the filter;

FIG. 6 a schematic view of four aerodynamically designed guide elements arranged as a cross;

FIG. 7 a cross-sectional side view of an alternative fan module comprising a centrifugal fan with a tangential outlet;

FIG. 8 a schematic cross-sectional side view of an alternative fan module, comprising a hub with channel attachment to a central fan, which is used for several fan modules;

FIG. 9 a piece of a construction material for channel walls and/or guide elements, which can be made of foam glass, with a waved surface and through holes; and FIG. 10 guide element arrangements in a fan module according to the invention.

DESCRIPTION OF PREFERRED EMBODIMENTS

The invention will now be described more in detail with reference to preferred embodiments of the invention shown in the drawings, which however may be varied with the scope of the following claims.

In the schematic drawing in FIG. 1, a fan module 1 is shown, stacked according to the module principle on a filter docking unit 2 with a filter 3 suspended therein. The filter docking unit lies in its turn on a roof filter frame, suggested by two rims 4, shown in cross-section. The fan module 1 has outer restriction walls 5 with a lower edge part 6 with a planar lower surface 7 facing downwards, resting on a corresponding, planar upper surface 8 facing upwards of the filter docking module 2. Around said lower surface on the fan module facing downwardly a protruding element is arranged, in the embodiment shown in the form of a rim 9, which overlaps the upper part of the sidewalls 10 of the filter docking module. In this way the fan module may be installed conveniently and the dead weight is sufficient for it to be safely kept in place, and no extra attachment measures are needed. By designing other modules in the same way, such as cooling battery, pre-filter, silencing module, a fan-filter-unit can be built up by easily exchangeable or transpositionable modules, which gives a maximum of flexibility. By designing the fan module with a planar upper edge surface 11 other modules can be added, such as cooling battery, pre-filter.

In FIG. 2, an inlet channel to a centrifugal fan in the fan module is shown. An inlet cross 21 is arranged in the air inlet channel 20. With this inflow cross a flow stabilization is achieved which reduces vortex formation and reduces noise.

The inlet flow cross 21 is covered with noise absorbing material or is made of such material. Preferably, it has a shark skin surface for minimizing the air resistance.

On the inside the flow channel is covered with insulation, preferably having a waved surface 30 as the piece of insulation material shown in FIG. 3. Troughs and crests, respectively of the waves are thus arranged so that they lie in parallel with the direction of the air flow.

In FIG. 4, a fan module 40 with centrifugal fan 41 is shown schematically and in cross-section. The centrifugal fan is suspended so that maximum noise silencing is obtained, which is previously known per se. On the walls of the room 42 surrounding the centrifugal fan, into which the air flows, the walls are dressed with or made of noise silencing material 43 with a waved surface, whereby the troughs and crests of the waves are arranged in parallel with the flow direction of the air. Further, guide elements 45,46 arranged in the room 42 are lined with or made of noise silencing material, also with a waved surface with troughs and crests of the waves in parallel with the air flow direction. The room has a lower restriction wall or bottom 47 with an outer gap 48 towards the vertical walls 49,50 limiting the room.

FIG. 5 shows a schematic cross-sectional view taken from above of a preferred embodiment with four guide elements 51,52,53,54 arranged crosswise.

The guide elements give a stabilisation of the flow and provides a substantial reduction of low-frequency noise. The insulation on the walls and baffles give a reduction of the high-frequency sound. With said surface structure on the surfaces surrounding the air flow a flow with minimal losses and without disturbances is achieved.

A schematic view of the discharge room surrounding the centrifugal fan is shown in FIG. 6 with four aerodynamically designed guide elements 61,62,63,64. As shown in the drawing the guide elements are made of insulation material with through holes or channels therein 65,66,67,68, which will add further to the noise reduction.

An alternative fan module 70 is shown in FIG. 7 with another type of fan 71 having a tangential outlet 72. After the fan in the direction of flow an assembly of guide elements 74 is arranged in an outlet channel 73 with a cross-section like a cross in order to obtain a flow stabilization. As discussed above, the walls in the discharge room as well as the guide elements are lined with or made of sound absorbing material with a waved surface and where the troughs and crests of the waves run in the flow direction of the air.

In FIG. 8 an alternative embodiment of the fan module according to the invention is shown. In this case the fan module is a hood 80, provided with the attachment means discussed above. The hood has a channel fitting 81 and is connected with a platinum chamber, not shown, to which air is supplied from a centrally arranged fan and which serves a number of fan-filter-units. In the embodiment shown an air distribution means 82 is arranged in front of the air outlet from the channel fitting, and the filter has been replaced by a filter roof module 83.

In FIG. 9 a piece of construction material 90 is shown, which according to a preferred embodiment is made of foam glass, with a waved surface 91 and with through holes 92 taken up in the material. With this a maximum sound-absorbing effect is achieved of both high-frequency and low-frequency sound.

Finally, in FIG. 10 is shown a further example of arrangements of guide elements 100 in a discharge room surrounding a centrifugal fan. The guide elements which are 8 in number all have a waved surface with the waves arranged in parallel with the air flow from the fan and on the restriction walls of the room the waves are also arranged so that the air flows in parallel therewith.

What is claimed is:

1. A fan module for clean room applications, comprising:

outer, vertical restriction walls with a lower edge part having a planar lower surface as well as an element protruding from an outer edge of said planar lower surface for cooperation with a filter docking module provided in a roof filter frame having a substantially planar upper surface with an extension corresponding to said planar lower surface, said protruding element being designed to overlap part of the filter docking module, a fan with an inlet channel for air, restriction walls defining a discharge room for air leaving said fan, air flow influence means arranged in said inlet channel and discharge room, and noise absorbing material provided on said air flow influence means and said walls of said discharge room, said noise absorbing material having a waved surface with troughs and crests arranged in parallel with the direction of the air flow.

2. A fan module according to claim 1, wherein said air flow influence means comprise an inflow baffle in said inlet channel in the form of two crossed rod-shaped elements consisting of or lined with said noise absorbing material.

3. A fan module according to claim 2, wherein said inflow baffle has a shark skin surface.

4. A fan module according to claim 1, wherein said air flow influence means comprise at least one guide element arranged in said discharge room and consisting of or lined with said noise absorbing material.

5. A fan module according to claim 4, wherein said fan comprises a circumferentially open centrifugal fan, said discharge room surrounds said centrifugal fan and has substantially rectangularly arranged outer vertical side walls, a roof and a bottom, said outer edge of said bottom and said side walls defining a gap connecting said discharge room with a space which on one side, which is parallel to said bottom, is intended to be restricted by a filter placed in the filter docking module, and said air flow influence means comprise at least two guide elements arranged in said discharge room for directing the air coming from said centrifugal fan towards and along said side walls in parallel with said troughs and crests.

6. A fan module according to claim 5, wherein said guide elements are aerodynamically designed.

7. A fan module according to claim 1, wherein said fan has a tangential air outlet opening into an air discharge channel in said discharge room, and said air flow influence means comprise elongated guide elements distributed across the cross-section of said air discharge channel and consisting of or lined with said noise absorbing material, said troughs and crests of said noise absorbing material running in the direction of the air flow.

8. A fan module according to claim 1, further comprising a planar upper edge surface for addition of other fan module elements such as a cooling battery and/or a pre-filter.

9. A fan module according to claim 1, wherein the fan module is connectable to the filter docking module through one or more intermediate modules.

10. A fan module according to claim 1, wherein the fan module is semi-detachable by one or more further elements such as a cooling battery and/or a pre-filter.

11. A fan module for clean room applications, comprising:

a fan with an inlet channel for air, walls defining a discharge room for air leaving said fan, air flow influence means arranged in said inlet channel and discharge room, and noise absorbing material provided on said air flow influence means and said walls of said discharge room, said noise absorbing material having a waved surface with troughs and crests arranged in parallel with the direction of the air flow.

* * * * *